US007445291B2

(12) United States Patent
Parkel et al.

(10) Patent No.: US 7,445,291 B2
(45) Date of Patent: Nov. 4, 2008

(54) CHAIR FOOTREST MECHANISM

(76) Inventors: Yvonne Parkel, 614 Linda La., Auburndale, FL (US) 33823; Robert Clark, 614 Linda La., Auburndale, FL (US) 33823

( * ) Notice: Subject to any disclaimer, the term of this patent is extended or adjusted under 35 U.S.C. 154(b) by 0 days.

(21) Appl. No.: 12/039,855

(22) Filed: Feb. 29, 2008

(65) Prior Publication Data

US 2008/0217982 A1 Sep. 11, 2008

Related U.S. Application Data

(60) Provisional application No. 60/893,682, filed on Mar. 8, 2007.

(51) Int. Cl.
*A47C 7/50* (2006.01)

(52) U.S. Cl. ..... 297/423.1; 297/423.19; 297/423.26; 297/463.1

(58) Field of Classification Search ..... 297/423.1, 297/463.1, 423.19, 423.22, 423.26, 423.28
See application file for complete search history.

(56) References Cited

U.S. PATENT DOCUMENTS 619,467 A * 2/1899 Cook ..... 297/423.22
2,458,618 A * 1/1949 McDonald ..... 182/88
5,312,155 A * 5/1994 Akima et al. ..... 297/180.13
5,458,399 A * 10/1995 Gezari et al. ..... 297/411.2
5,560,679 A * 10/1996 Barnholdt ..... 297/250.1
6,533,360 B1 * 3/2003 Parkel et al. ..... 297/423.28
6,692,068 B1 * 2/2004 Tang ..... 297/16.2
6,733,081 B1 * 5/2004 Follon et al. ..... 297/423.26

* cited by examiner

*Primary Examiner*—Laurie K Cranmer
(74) *Attorney, Agent, or Firm*—Baker, Donelson, Bearman, Caldwell & Berkowitz, PC

(57) ABSTRACT

A footrest mechanism is disclosed which is adapted to be coupled to a chair to allow a footrest (120) to be moved between an extended position and a retracted position. The footrest mechanism includes a mounting member (104) having a guide pin (109) and a release member (106) having an L-shaped slot (110) configured to receive the guide pin. The L-shaped slot (110) includes a generally horizontal portion (111) extending from a generally vertical portion (112) at least partially defined by a stop wall (113). The release member (106) also includes a handling tab (107) which facilitates the operation of the footrest mechanism (102) for movement of the footrest (120) between extended and retracted positions.

16 Claims, 5 Drawing Sheets

CHAIR FOOTREST MECHANISM

CROSS REFERENCE TO RELATED APPLICATION

This application claims the benefit of priority to U.S. Provisional Patent Application Ser. No. 60/893,682, entitled "CHAIR FOOTREST MECHANISM" and filed on Mar. 8, 2007, which is incorporated by reference herein.

BACKGROUND

Hair stylists and the like typically utilize a pivoting chair while styling the hair of an individual. Usually, these chairs are equipped with a U-shaped footrest which extends downwardly from the front of the chair's seat. Even though these chairs are hydraulically driven to raise and lower the seat portion relative to the underlying floor, elderly or handicapped individuals find it difficult to enter into and remove themselves from these chairs. This difficulty arises from the inaccessibility of the seat due to the positioning of the frontwardly extending footrest. Oftentimes, with the limited physical capabilities of these individuals, they are unable to maneuver themselves from a body supporting device, such as a cane, a wheelchair or a walker, over the footrest and onto the seat. As such, these individuals must be hoisted into these chairs, which is inefficient for the hair stylists and causes the individuals to experience not only the discomfort of being hoisted, but also the indignity associated with needing to be hoisted even for a simple task such as sitting in a hair stylist's chair. Alternatively, these individuals must be seated on conventional, non-pivoting chairs, thus also making the hair stylist's job considerably more difficult to complete.

Accordingly, it is seen that a need remains for a chair footrest mechanism which enables a person with limited mobility to access the chair seat but which still enables the feet of a seated individual to be supported. It is to the provision of such therefore that the present invention is primarily directed.

SUMMARY OF THE PRESENT INVENTION

A chair footrest mechanism comprises a mounting member adapted to be coupled to a chair with the mounting member including a guide pin, a release member having an L-shaped slot therethrough configured to receive the mounting member guide pin to allow sliding relative movement between the release member and the mounting member as the guide pin moves along the L-shaped slot, and a footrest supporting member including at least one leg having an end pivotally coupled to the mounting member about a first pivot point and pivotally coupled to the release member about a second pivot point. With this construction, the footrest support member may be moved between a retracted position and an extended position through the guided movement between the mounting member and the release member through movement of the guide pin along the L-shaped slot.

DETAILED DESCRIPTION

Figure 1A:
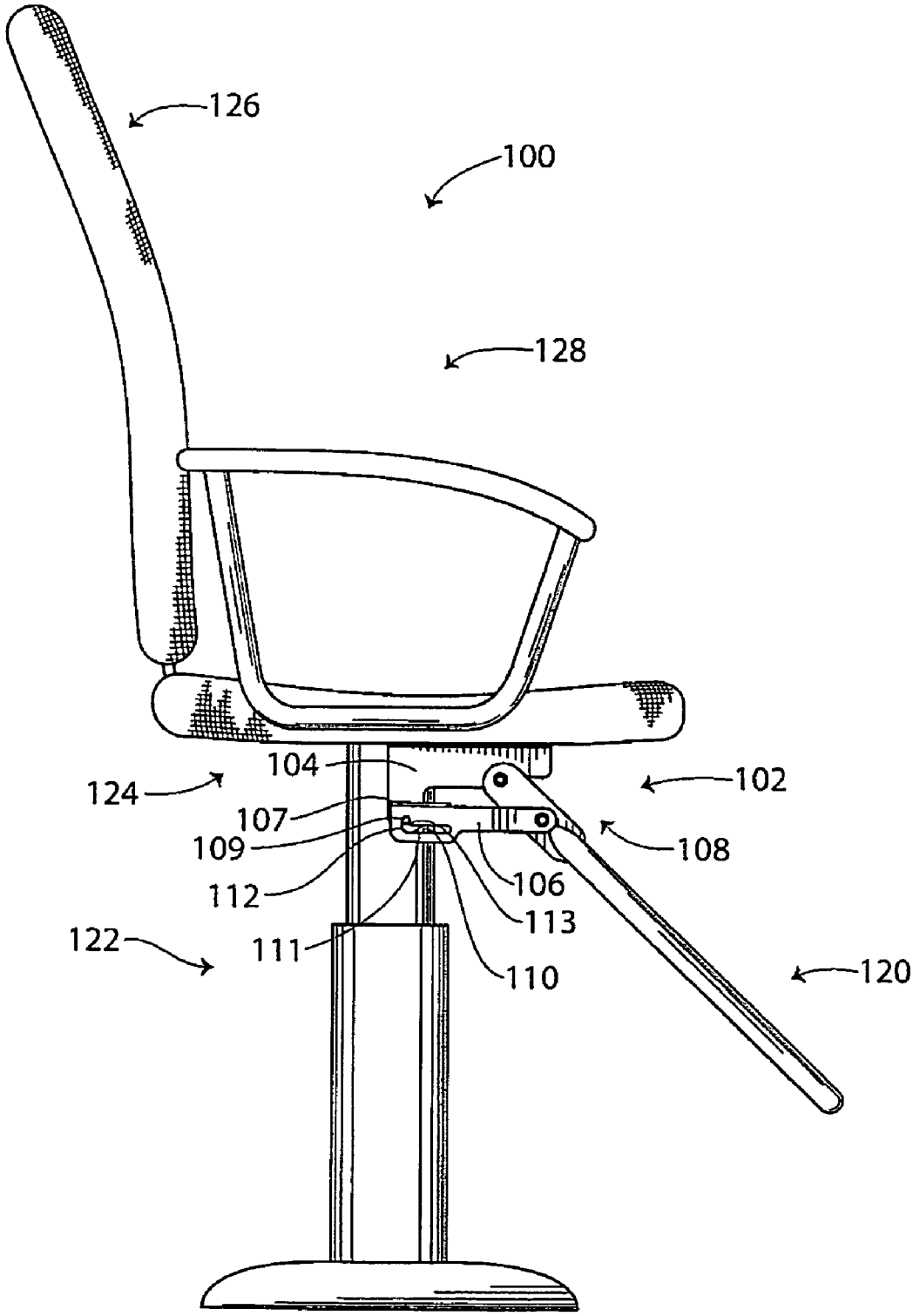
FIG. 1A is a left side view of a chair including a chair footrest mechanism in a preferred form of the invention, shown with a footrest in an extended position.
Figure 1B:
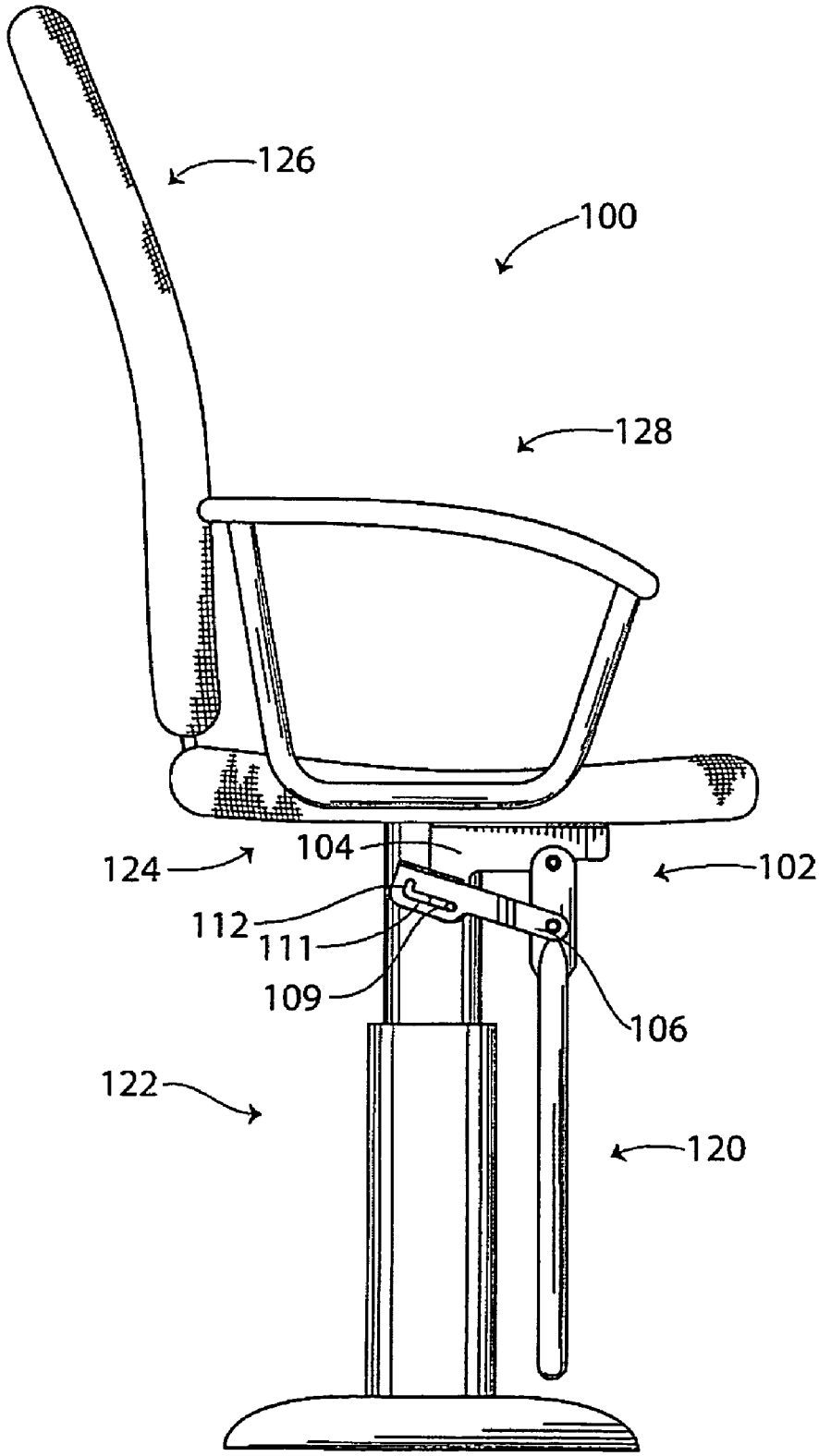
FIG. 1B is a left side view of the chair of FIG. 1A, shown with a footrest in a retracted position.

With reference to the drawings, FIGS. 1A and 1B are left-side views of a chair 100 in accordance with exemplary embodiments of the invention. The exemplary chair 100 may, for example, be in the form of a hair stylist chair that includes a footrest 120, a hydraulically driven pedestal or frame 122 depending from a seat portion 124, a backrest 126, and a pair of arms 128, all of which may be coupled (e.g., directly or intermediately) to the seat portion 124 as depicted.

In accordance with exemplary embodiments of the invention, the chair 100 also include a footrest mechanism 102, which may be coupled to the chair seat portion 124 and the footrest 120 as shown. It should be understood that the exemplary footrest mechanism 102 may or may not include part or all of the footrest 120 in some exemplary embodiments. Elements and aspects of the footrest mechanism 102 will be discussed below. Moreover, aspects of the coupling or other connectivity of the various elements discussed herein, as well as the materials and construction thereof, will also be discussed below.

It is noted that FIG. 1A shows the footrest 120 in an extended position via the footrest mechanism 102. In contrast, FIG. 1B shows the footrest 120 in a stowed or retracted position (e.g., beneath the seat portion 124) via the footrest mechanism 102. Thus, in FIG. 1A, the footrest mechanism 102 is in an extended configuration, while in FIG. 1B, the footrest mechanism 102 is in a retracted configuration.

Figure 2A:
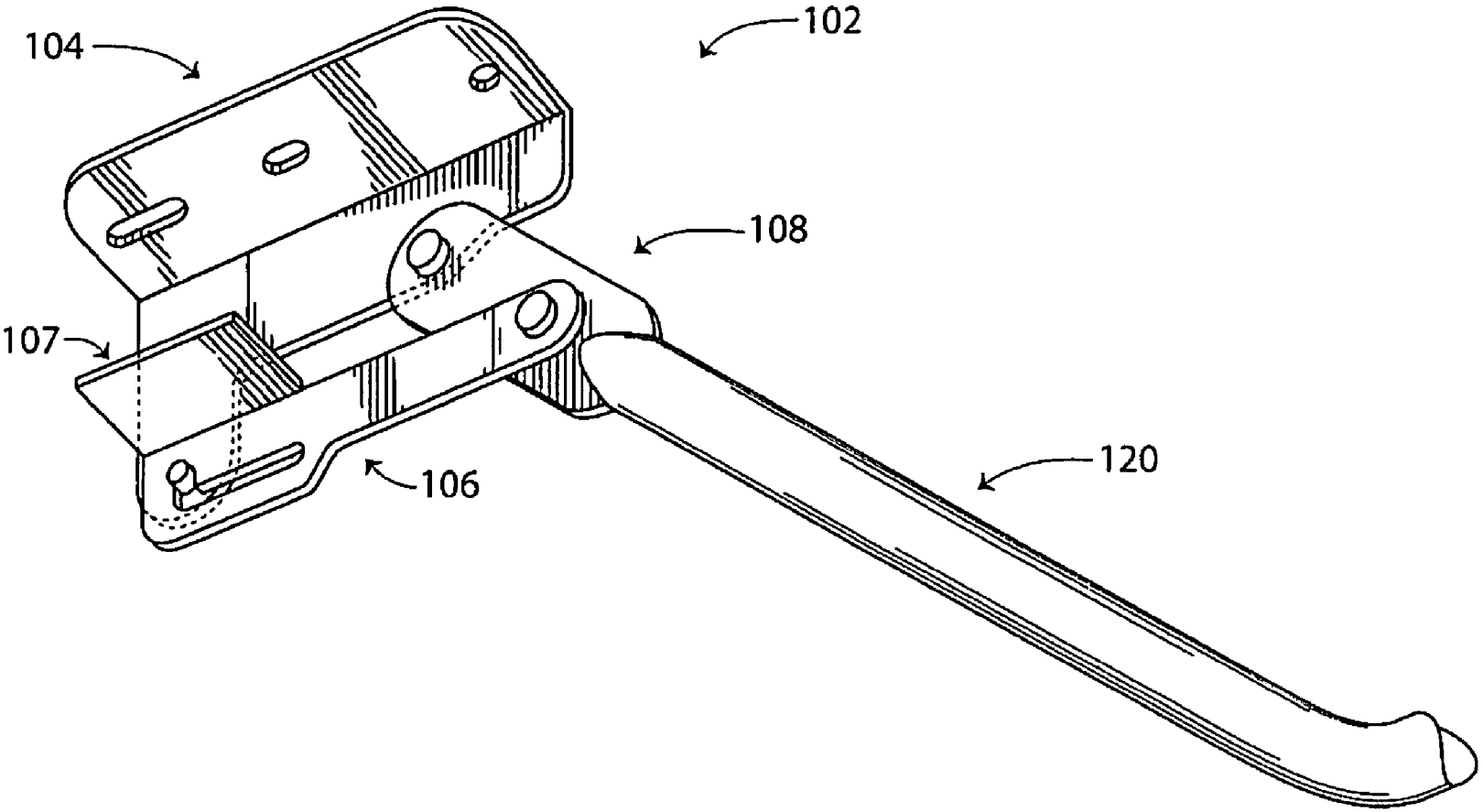
FIG. 2A is perspective view of the left side of the footrest mechanism of FIG. 1A.
Figure 2B:
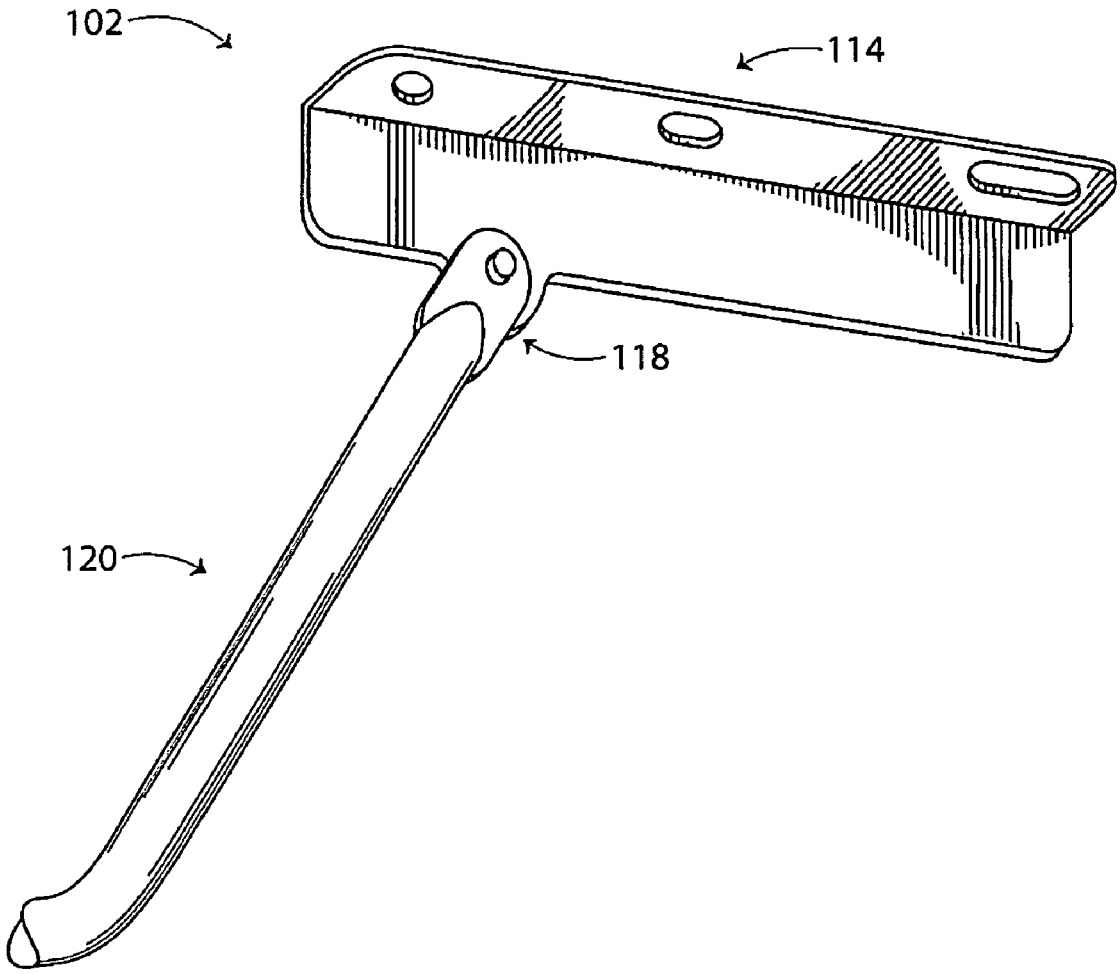
FIG. 2B is a perspective view of the right side of the footrest mechanism of FIG. 1A.

Turning now to FIGS. 2A and 2B, a more detailed left-side view and right-side view of the footrest mechanism 102 are shown respectively. With respect to FIG. 2A, the footrest mechanism 102 includes a left-side mounting member 104. This left-side mounting member 104 may be coupled to the chair seat portion 124 (e.g., as shown in FIG. 1) and the footrest 120. The left-side mounting member 104 is typically moveably engaged with a latch release member 106, which is discussed below. As shown in the FIG. 2A, the mounting member 104 may include one or more penetrations through it (e.g., holes, slots, voids, etc.) that may facilitate the coupling of the mounting member 104 to other elements of or in communication with the footrest mechanism 102. The mounting member 104 includes a bearing or guide pin or post 109, or other similar device such as a stud, rivet, screw, bolt, etc.

As mentioned above, the footrest mechanism 102 may include part or all of the footrest 120 in some exemplary embodiments. For example, as shown in FIG. 2A, a portion 108 of the typically tubular constructed footrest 120 may be flattened into a spade-like shape (further exemplified in FIG. 3) to facilitate its coupling to the mounting member 104 and latch release member 106 as depicted in FIG. 2A. Moreover, such portion 108 of the footrest 120 may be a separable element from the footrest 120 in some embodiments that can be coupled to the remaining U-shaped portion of the footrest 120.

As also mentioned above, the mounting member 104 is also typically moveably engaged with a latch release member 106. As shown in FIG. 2A, the latch release member 106 includes a penetration through it, such as an L-shaped slot 110, along which the mounting member 104 can moveably engage the release member 106 via the bearing pin 109. The L-shaped slot 110 includes a generally horizontal portion 111 extending from a generally vertical portion 112 at least partially defined by a stop wall 113. As further shown, the release member 106 may include other penetrations that may facilitate the coupling of the mounting member 104 to other elements of or in communication with the footrest mechanism 102. Also shown in some of the views of the release member 106 is an outwardly extending handling tab 107, which may be either integral or coupled to the release member 106 and typically facilitates the operation of the footrest mechanism 102 via the release member 106 as discussed below. For example, looking back to FIGS. 1A and 1B, the moveable engagement of the mounting member 104 with the latch release member 106 during the movement of the footrest 120 between extended and retracted positions via the footrest mechanism 102 is depicted.

With respect to FIG. 2B, the footrest mechanism 102 may also include a right-side mounting member 114 in accordance with some exemplary embodiments of the invention. This right-side mounting member 114 may also be coupled to the chair seat portion 124 (not depicted) and the footrest 120. As shown in FIG. 2B, the mounting member 114 includes one or more penetrations through it (e.g., holes, slots, voids, etc.) that may facilitate the coupling of the mounting member 114 to other elements of or in communication with the footrest mechanism 102.

Similar to the above discussion of the left-side mounting member 104, a portion 118 of the typically tubular constructed footrest 120 may be flattened into a spade-like shape (as shown for example in FIG. 2B and further shown in FIG. 3) to facilitate its coupling to the mounting member 114 as depicted in FIG. 2B. Moreover, such portion 118 of the footrest 120 may be a separable element from the footrest 120 in some embodiments that can be coupled to the remaining U-shaped portion of the footrest 120.

Figure 3:
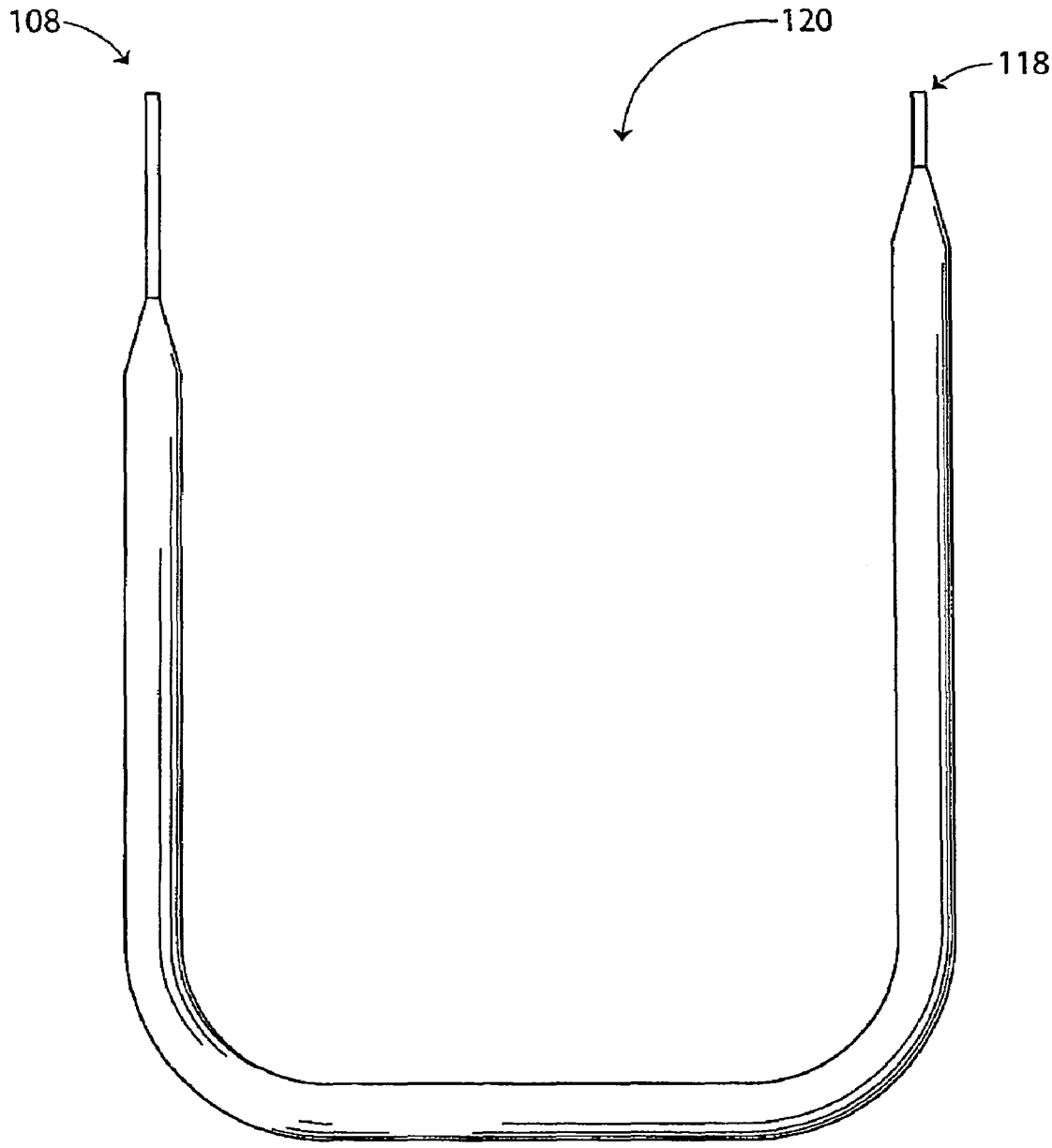
FIG. 3 is a front view of the footrest of the chair of FIG. 1A.

FIG. 3 shows a front view of a footrest 120 in accordance with exemplary embodiments of the invention. The exemplary footrest 120 has already been discussed above with respect to the footrest mechanism 102. The view of the footrest 120 in FIG. 3 exemplifies the typical (although not exclusive) tubular construction that was referred to above. Additionally, the view of FIG. 3 shows the exemplary spade-like portions 108, 118 of (e.g., integral or coupled to) the leg portions of the footrest 120, which, as discussed above, are typically coupled to the latch release member 106 and left-side mounting member 104 and to the right-side mounting member 114 respectively. As discussed further below, in a typical usage, a user seated in a chair (see e.g., FIG. 1A) can place his/her feet (whether covered with footwear, bare, etc.) on the footrest to obtain support, comfort, stability, etc. while sitting in or otherwise interfacing with the chair.

Regarding the discussion herein of exemplary embodiments of the invention (e.g., as discussed above), various elements of the embodiments are referred to as "coupled" to each other. In that regard, it should be understood and/or otherwise apparent to one of ordinary skill in the art in light of the disclosure herein that the term "coupled" has a broad meaning that includes conditions such as connected, attached, engaged, in communication with, etc. Furthermore, it should also be understood or otherwise apparent to one of ordinary skill in the art that such elements that are coupled, engaged, etc., may be so in various states, degrees, manners, etc., such as stationarily, moveably, pivotally or pivotably, hingedly, etc. For example, in a typical exemplary embodiment of the invention, the spade-like portion 108 of the footrest 120 is usually pivotally coupled to the mounting member 104 and latch release member 106 such that these elements can move about the point of coupling in at least one plane of rotation (see e.g., movement depicted between FIGS. 1A and 1B).

Furthermore, with respect to elements that are referred to herein as coupled, engaged, etc., there are numerous ways that this coupling, engaging, etc. can be implemented. For example, common connectors, fasteners, etc. may be used, such as screws, bolts, rivets, pins, studs, etc. Such numerous ways of coupling, engaging, or otherwise communicating among the elements with respect to exemplary embodiments of the invention are either known or will be apparent to one of ordinary skill in the art in light of the disclosure herein.

Moreover, regarding the various elements of exemplary embodiments of the invention discussed herein, it should be understood and/or otherwise apparent to one of ordinary skill in the art in light of the disclosure herein that such elements may be constructed in numerous forms, shapes, sizes, etc. of numerous materials, compositions, etc., using numerous methods, processes, procedures, etc. For example, as shown in some of the figures that will be discussed below, exemplary embodiments of the invention may include elements that are constructed of metallic materials such as steel, aluminum, alloys, etc.

In an exemplary usage of the footrest mechanism 120 (e.g., starting with the configuration shown in FIG. 1A), a user, such as a hair stylist wishing to seat an individual upon the chair 100, an individual wishing to seat his/her-self upon the chair 100, etc., may first engage (e.g., using a hand or other appropriate means) the latch release member 106. Typically, this engaging includes applying an upward and/or other force upon the handling tab 107 of the release member, the positioning of the handling tab 107 vertically adjacent the L-shaped slot ensures that the movement of the handling tab is directed upon the L-shaped slot with a minimal effect of the pivoting motion of the release member. It should be understood that the tab may alternatively be positioned vertically below the L-shaped slot. Such force allows the mounting member 104, through the relative movement of pin 109 from the slot vertical portion 112 to the slot horizontal portion 111, to moveably engage the release member 106. During such engaging (as exemplified by FIGS. 1A and 1B), the spade-like portions 108, 118 of the footrest 120 can pivotally engage the left-side mounting member 104 and release member 106 and the right-side mounting member 114 respectively. As a result, the footrest 120 can move from an extended position (e.g., as in FIG. 1A) to a retracted position (e.g., as in FIG. 1B). In the extended position, the stop wall 113 of the release member 106 bears against the guide pin 109 so that the guide pin 109 resides in a locked position within the vertical portion 112 of the L-shaped slot of the mounting member 104. With the guide pin 109 positioned within the vertical portion 112 and bearing against stop wall 113 the release member is in a "locked" position. As such, the application of a downward pressure upon the footrest simply causes the guide pin to bear harder against the stop wall 113 and thereby prevents the footrest from moving or pivoting downwardly.

In the retracted position, the end of the horizontal portion of the L-shaped slot bears against the pin 109 of the mounting member 104, i.e., reside within the horizontal portion 111 of the L-shaped slot. The pin of the mounting member 104 may be a screw, bolt, or other component that can be adjusted to selectively hold the release member 106 against the mounting member 104 in a fixed position such as the extended position, the retracted position, or a position between the extended and retracted positions. Depending on the configuration, positioning, etc. of the chair 100, the footrest 120, the footrest mechanism 102, etc., the movement of the footrest 120 from an extended position to a retracted position may occur as a result of gravity. Alternately, the user or individual may apply force to some portion of the footrest mechanism 102 (e.g., the handling tab 107 and/or other portion of the latch release member 106), the footrest 120, and/or other elements to move the footrest 120 to the retracted position. Moreover, the footrest may be retracted by other methods that will be apparent to one of ordinary skill in the art based on the disclosure herein.

As discussed briefly above, with the footrest 120 in the retracted position, an individual can be seated upon the chair 100 without potential interference from the footrest 120 that could result in instability, falls, and/or other undesirable occurrences by the individual, the user, etc. Once the individual has become seated in the chair 100, the footrest can be moved back to the extended position to provide support for the individual's feet as discussed above. This extending movement of the footrest can be implemented by various methods. For example, the user may, similar to above, engage the release member 106 (e.g., via the handling tab 107) and/or the footrest 120 and apply a force accordingly to move the footrest to the extended position. As another example, the seated individual may place his/her feet (e.g., via the heal portion of the worn footwear) on the footrest 120 and move it to the extended position, for example, with a forward kicking motion. Moreover, the footrest may be extended by other methods that will be apparent to one of ordinary skill in the art based on the disclosure herein. It is noted that various configurations (e.g., by size, shape, weight, etc.) of elements of the footrest mechanism 102, footrest 120, and/or the chair 100 may facilitate the retraction and extension of the footrest 120 in manners such as those discussed above. With the upward movement of the footrest 120, the bearing pin 109 is moved from the horizontal portion 111 to the vertical portion 112 of the L-shaped slot so as to lock the position of the footrest.

It should be understood that the foregoing descriptions merely relate to exemplary, illustrative embodiments of the invention. Therefore, it should also be understood that various modifications may be made to exemplary embodiments described herein that are within the scope of the invention, which will be recognized by one of ordinary skill in the art in light of the disclosure herein. Furthermore, various elements of the described exemplary embodiments of the invention may be known in the art or recognized by one of ordinary skill in the art based on the disclosure herein.

The invention claimed is:

1. A chair footrest mechanism comprising:

a mounting member adapted to be coupled to a chair, said mounting member including a guide pin;

a release member having an L-shaped slot therethrough configured to receive said mounting member guide pin to allow sliding relative movement between said release member and said mounting member as said guide pin moves along said L-shaped slot, and a footrest supporting member including at least one leg having an end pivotally coupled to said mounting member about a first pivot point and pivotally coupled to said release member about a second pivot point, whereby the footrest support member may be moved between a retracted position and an extended position through the guided movement between the mounting member and the release member through movement of the guide pin along the L-shaped slot.

2. The chair footrest mechanism of claim 1 wherein said release member includes an outwardly extending handling tab to allow manual actuation of said release member.

3. The chair footrest mechanism of claim 2 wherein said release member is positioned vertically adjacent said L-shaped slot.

4. The chair footrest mechanism of claim 1 further comprising a second mounting member coupled to the chair and wherein said footrest supporting member includes a second leg pivotally coupled to said second mounting member.

5. The chair footrest mechanism of claim 1 wherein said L-shaped slot includes a vertical portion and a generally horizontal portion, and wherein said vertical portion includes a stop wall upon which said guide pin bears upon with the footrest supporting member in an extended position.

6. A chair footrest mechanism comprising:

a mounting member adapted to be coupled to a chair;

a release member;

coupling means for coupling said mounting member and said release member, said coupling means including a guide pin and an L-shaped slot configured to receive said guide pin for guided movement along said L-shaped slot to impart guided relative movement between said mounting member and said release member, and a footrest supporting member including at least one leg having an end pivotally coupled to said mounting member about a first pivot point and pivotally coupled to said release member about a second pivot point, whereby the footrest support member may be moved between a retracted position and an extended position through the guided movement between the mounting member and the release member through movement of the guide pin along the L-shaped slot.

7. The chair footrest mechanism of claim 6 wherein said release member includes said L-shaped slot and said mounting member includes said guide pin.

8. The chair footrest mechanism of claim 7 wherein said release member includes an outwardly extending handling tab to allow manual actuation of said release member.

9. The chair footrest mechanism of claim 8 wherein said release member is positioned vertically adjacent said L-shaped slot.

10. The chair footrest mechanism of claim 6 further comprising a second mounting member coupled to the chair and wherein said footrest supporting member includes a second leg pivotally coupled to said second mounting member.

11. The chair footrest mechanism of claim 6 wherein said L-shaped slot includes a vertical portion and a generally horizontal portion, and wherein said vertical portion includes a stop wall upon which said guide pin bears upon with the footrest supporting member in an extended position.

12. A chair comprising:

a seat portion;

a frame supporting said seat portion above a supporting surface;

a footrest coupled to said seat portion, said footrest including a mounting member coupled to said seat portion, said mounting member including a guide pin, a release member having an L-shaped slot therethrough configured to receive said mounting member guide pin to allow sliding relative movement between said release member and said mounting member as said guide pin moves along said L-shaped slot, and a footrest supporting member including at least one leg having an end pivotally coupled to said mounting member about a first pivot point and pivotally coupled to said release member about a second pivot point, whereby the footrest support member may be moved between a retracted position and an extended position through the guided movement between the mounting member and the release member through movement of the guide pin along the L-shaped slot.

13. The chair footrest mechanism of claim 12 wherein said release member includes an outwardly extending handling tab to allow manual actuation of said release member.

14. The chair footrest mechanism of claim 13 wherein said release member is positioned vertically adjacent said L-shaped slot.

15. The chair footrest mechanism of claim 12 further comprising a second mounting member coupled to the chair and wherein said footrest supporting member includes a second leg pivotally coupled to said second mounting member.

16. The chair footrest mechanism of claim 12 wherein said L-shaped slot includes a vertical portion and a generally horizontal portion, and wherein said vertical portion includes a stop wall upon which said guide pin bears upon with the footrest supporting member in an extended position.

* * * * *